US006450760B1

(12) United States Patent
Furukawa et al.

(10) Patent No.: US 6,450,760 B1
(45) Date of Patent: Sep. 17, 2002

(54) FAN DEVICE

(75) Inventors: Hideo Furukawa; Toshihiko Nishiyama; Kengo Koshimizu, all of Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/715,094

(22) Filed: Nov. 20, 2000

(30) Foreign Application Priority Data

Nov. 22, 1999 (JP) ..... 11-331543

(51) Int. Cl.[7] ..... F04D 29/66

(52) U.S. Cl. ..... 415/119; 415/173.6; 415/173.4; 416/169 A; 416/189; 416/192; 416/228

(58) Field of Search ..... 415/119, 173.1, 415/173.6, 170.1, 173.4, 174.5, 220, 914; 416/169 A, 189, 192, 228; 123/41.49

(56) References Cited

U.S. PATENT DOCUMENTS 3,680,977 A * 8/1972 Rabouyt et al. ..... 277/369
3,799,128 A * 3/1974 Small ..... 415/173.4
3,937,192 A * 2/1976 Longhouse ..... 416/189
4,406,581 A * 9/1983 Robb et al. ..... 416/228
4,566,852 A * 1/1986 Hauser ..... 416/189
5,183,382 A * 2/1993 Carroll ..... 416/192
5,884,589 A * 3/1999 Sakamoto et al. ..... 123/41.49
6,024,536 A 2/2000 Tsubakida et al. ..... 416/189

FOREIGN PATENT DOCUMENTS

| | | |
|---|---|---|
| EP | 0 780 556 | 6/1997 |
| EP | 0 881 395 | 12/1998 |
| GB | 0835177 | 5/1960 |
| GB | 2 070 688 | 9/1981 |
| GB | 2 116 642 | 9/1983 |

OTHER PUBLICATIONS

British Search Report dated May 9, 2001.

* cited by examiner

*Primary Examiner*—Edward K. Look
*Assistant Examiner*—Richard Woo
(74) *Attorney, Agent, or Firm*—Armstrong, Westerman & Hattori, LLP.

(57) ABSTRACT

A curved section (12) is provided at a proximal end of a fan (10), so that a rotation locus thereof is configured in a shape conforming to a flow of a cooling air such as center-dented. Accordingly, the cooling air can be smoothly sucked in by the fan (10) as well as fan shroud along an arcuate section on an inlet side. Further, since natural flow toward radially outward flow of the cooling air can be guided by an arcuate section on an outlet side, thus smoothly discharging the cooling air. Therefore, the flow of the cooling air can be made smooth entirely from upstream to downstream, thus increasing flow rate and reducing noise.

4 Claims, 13 Drawing Sheets

COMPARISON OF FAN NOISE AT THE SAME WIND FLOW

FAN DEVICE

BACKGROUND OF THE INVENTION

1. Field of the Invention

The present invention relates to a fan device. More specifically, it relates to an improvement of a fan device for an engine cooling system of industrial application including construction equipment such as an excavator and other vehicles or a fan device for various industrial cooling system.

2. Description of Related Art

Conventionally, in an engine-cooling system of vehicle etc., an engine is cooled by a coolant circulating between the engine and a radiator. The coolant is cooled by a cooling air sucked in or pushed by a fan adjacent to the radiator.

FIG. 13 shows a conventional fan 92 disposed between a radiator 91 and an engine (not shown). The fan 92 has an approximately cylindrical rotation locus around a rotation axis (not shown) drawn by respective edges during rotation. An outer circumference of the cylindrical rotation locus often traces a straight section 94 parallel to the axis line of the rotation axis, irrespective of difference in profile of a fan shroud 93 opposing an outer circumference of the fan 92.

For improving performance of the fan, flow rate of the fan has to be increased without changing size and rotation frequency of the fan and noise such as jet noise caused by swirl has to be reduced.

However, since a configuration of proximal end of the fan 92 is the straight section 94 and the configuration of the fan shroud 93 is bell-mouth shaped at an inlet side and an outlet side, a tip clearance between the proximal end of the fan 92 and the fan shroud 93 is enlarged at the inlet side and the outlet side, so that large number of swirl is generated, thus preventing smooth flow of cooling air.

In other words, increase in flow rate of the cooling air and noise reduction can be limited according to a combination of the fan and the fan shroud having the configuration shown in FIG. 13, and solution thereof has been desired.

SUMMARY OF THE INVENTION

An object of the present invention is to provide a fan device capable of securely increasing flow rate and reducing noise. In the present invention, the above object is achieved by modifying configuration of proximal end of a fan.

Specifically, a fan device according to the present invention has a fan, a rotation locus of an outer configuration of a proximal end of the fan being center-dented where a middle section along a direction parallel to an axis line of a rotation axis of the fan is dented relative to both sides thereof on a substantially entire area parallel to the axis line of the rotation axis of the fan.

In the present invention, since the rotation locus of the proximal end of the fan is center-dented to conform to the flow of the cooling air, the cooling air can be smoothly sucked in along the configuration. Further, since natural flow toward radially outward flow of the cooling air can be guided by an arcuate section on an outlet side, thus smoothly discharging the cooling air. Therefore, the flow of the cooling air can be made smooth entirely from upstream to downstream, thus increasing flow rate and reducing noise.

Incidentally, in the present invention, the term "center-dented where a middle section along a direction parallel to an axis line of a rotation axis of the fan is dented relative to both sides thereof on a substantially entire area parallel to the axis line of the rotation axis of the fan" means a configuration of the approximately cylindrical rotation locus, where the middle section in the rotation axis direction of the rotation locus has relatively small diameter and both sides sandwiching the middle section has relatively great diameter.

In such "center-dented configuration", the term "on a substantially entire area" is used for a concave configuration entirely continuous for naturally flowing the cooling air. A configuration having a circumferential groove-shaped center-dented section steeply sunk on a part parallel to the axis line or a fringe-shaped configuration having upstream side or downstream side thereof radially extending toward the outside is not included in the present invention.

Specifically, when the steep sunk section exists, the flow of the cooling air often does not go smooth on the upstream and downstream side of the rotation locus. When only the upstream side extends, the cooling air is not likely to flow naturally at the downstream side, thus unable to conduct smooth discharge. When only the downstream side extends, backflow of the cooling air is likely on the upstream side, so that the cooling air is difficult to be smoothly sucked in.

In the present invention, a fan shroud may preferably be provided spaced apart from the rotation locus of the proximal end of the fan by a predetermined gap, the gap being constant on substantially the entire area between the rotation locus and the fan shroud.

According to the above arrangement, since the gap between the rotation locus and the fan shroud is constant, the inner circumference of the fan shroud is formed in a shape corresponding to the flow of the cooling air, i.e. bell-mouth shape, so that the gap is uniformly narrowed on the entire area. Accordingly, the tip clearance between the fan and the fan shroud can be narrowed on the suction and discharge side of the cooling air, thus decreasing swirl. Further, since the outer diameter of the fan on the inlet side and the discharge side can be enlarged, workload of the fan can be increased, thus further increasing static pressure and the wind flow of the fan.

In the present invention, an outer diameter of the fan on a side of a body to be cooled may preferably be smaller than a minimum inner diameter of the fan shroud.

When the outer diameter of the fan on a side of the object to be cooled is greater than the minimum inner diameter of the fan shroud, the fan cannot be accommodated in the fan shroud after the fan shroud is fixed to a predetermined position. Accordingly, in such case, the fan shroud is arranged in a divisible type composed of a plurality of small components and the respective small components are attached in a frame-shape around the fan after the fan is disposed adjacent to the object to be cooled, so that working process can be limited and much work is required for attaching the respective components. Especially, when the fan device is applied to the cooling system of the engine, the attachment work of the small components has to be conducted by putting a hand in a narrow engine room, thus complicating work process.

On the other hand, since the outer diameter of the fan on the side of the object to be cooled is smaller than the minimum inner diameter of the fan shroud, the fan can be easily accommodated in the fan shroud even after the fan shroud is assembled in the frame-shape, so that the work process can be flexibly changed in accordance with install position of the fan device, thus improving workability.

In the present invention, at least a part of an inner circumference of the fan shroud may preferably be formed of a porous noise absorbing material opposing to the rotation locus.

According to the above arrangement, jet noise caused by swirl between the proximal end of the fan and the fan shroud can be absorbed on account of sound absorption ability of the porous noise absorbing material attached to the fan shroud, thus remarkably reducing the noise.

DETAILED DESCRIPTION OF PREFERRED EMBODIMENT(S)

Figure 1:
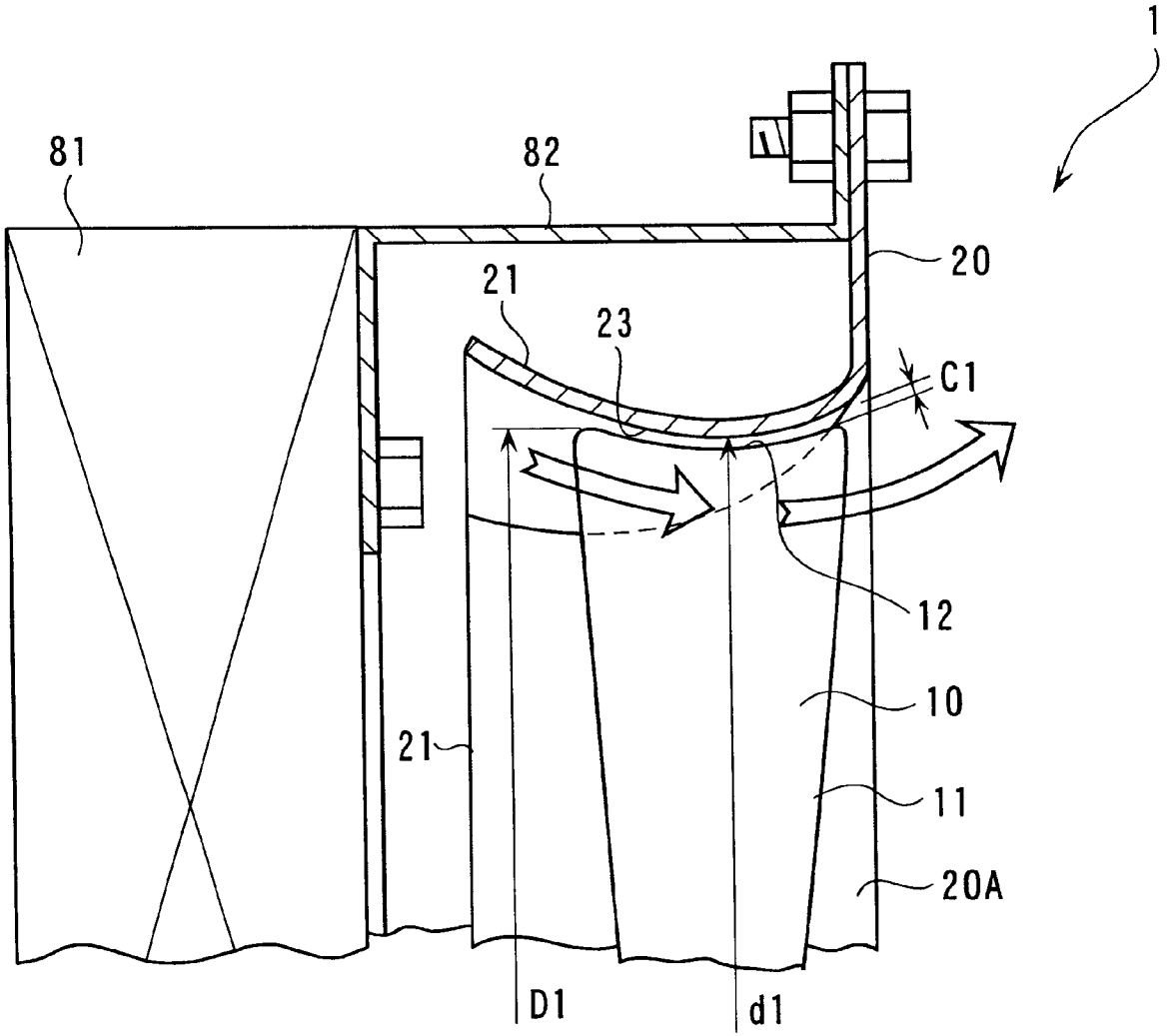
FIG. 1 is a cross section showing a primary section of a fan device according to first embodiment of the present invention.

Preferred embodiments of the present invention will be described below with reference to attached drawings. Incidentally, the same reference numeral will be attached to the same member or a member having the same function, thus omitting or simplifying repeated description thereof.

[First Embodiment]

FIG. 1 is a vertical cross section showing a primary section of a fan device 1 according to first embodiment.

The fan device 1 has a fan 10 disposed between a radiator 81 as a body to be cooled and an engine (not shown: located rightward in the figure), and a frame-shaped fan shroud 20 secured to the radiator 81 through a radiator hood 82 by a bolt and having an opening 20A for accommodating the fan 10.

The fan 10 has a plurality of vanes 11 provided around a rotation axis and is driven by an output power transmitted from a crankshaft of the engine via a pulley and a fan belt. Incidentally, only one vane 11 is illustrated and the rotation shaft and power transmission means such as the pulley are not shown in FIG. 1.

A proximal end of the fan 10 (vane 11) has an arcuate curved section 12 relative to the axis line of the rotation axis, i.e. being dented toward the rotation axis from both right and left ends to the center thereof, so that a configuration of a rotation locus drawn by the outer configuration of the proximal end in rotating the fan 10 is center-dented on substantially entire area in a direction parallel to the axis line, thus conforming with flow of cooling air on the proximal end side of the fan 10.

The curved section 12 is not necessarily configured in a single radius of curvature, but may be formed of a plurality of radius of curvatures.

The fan shroud 20 is a divisible type with a plurality of metal shroud body 21 divisible being separated into, for instance, four parts, the fan shroud 20 being disposed around the fan 10 in a frame-shape. Inner circumference of the fan shroud 20 located inside the radiator hood 82 is remote from the rotation locus of the outer configuration of the proximal end of the fan 10 by a predetermined gap.

The inner circumference of the fan shroud 20 has a bell-mouth shape having a curved section 23 formed in a radius of curvature the same as or slightly smaller than the curved section 12 of the fan 10, so that the gap between the rotation locus (curved section 12) of the fan 10 and the curved section 23 is constant on substantially the entire area, thus conforming with the flow of the cooling air.

An outer diameter D1 on the radiator 81 side of the fan 10 is greater than a minimum inner diameter d1 of the fan shroud 20 in the fan device 1.

Accordingly, after the fan shroud 20 is assembled in a frame-shape, it is difficult to accommodate the fan 10 into the opening 20A of the fan shroud 20. Therefore, the radiator 81 attached with the radiator hood 82 is disposed inside an engine room adjacent to the fan 10, and respective shroud bodies 21 sequentially attached to the radiator hood 82 while being disposed on the outer circumference side of the fan 10, thus constructing the frame-shaped fan shroud 20 to accommodate the fan 10 inside the opening 20A.

Then, after the cooling air passes the radiator 81 to exchange heat between the coolant by driving the fan 10 by the engine, the cooling air is sent to inlet side of the fan 10 and is discharged from the outlet side as shown in outline arrow in the figure.

According to the present embodiment, following effects can be obtained.

1) Since the curved section 12 is provided at the proximal end of the fan 10 to make rotation locus thereof center-dented to conform with the flow of the cooling air, the cooling air can be smoothly sucked in along the arcuate section on the inlet side (upstream side) by the fan 10. Further, since the natural flow of the cooling air can be guided by an arcuate section on the outlet side (downstream side), the cooling air can be smoothly discharged. Accordingly, the flow of the cooling air from the upstream to the downstream can be made totally smooth, thus increasing flow rate and reducing noise.
2) Since a gap C1 between the rotation locus by the outer configuration of the proximal end of the fan 10 and the fan shroud 20 is constant on the entire area and the inner circumference of the fan shroud 20 is made into a bell-mouth shape in conformity with the flow of the cooling air, the curved section 23 of the fan shroud 20 can be made evenly closer to the rotation locus. Accordingly, the gap C1 between the fan 10 and the fan shroud 20 at the inlet side and the outlet side of the cooling air can be narrowed, thus reducing development of turbulence. Further, since outer diameter of the fan 10 at the inlet side and the outlet side can be enlarged, workload of the fan 10 can be increased, so that static pressure and flow rate of the fan 10 can be further increased.

3) Though the outer diameter D1 of the fan 10 on the radiator 81 side is greater than the minimum inner diameter d1 of the fan shroud 20, since the radiator 81 is disposed adjacent to the fan 10 and the respective shroud bodies 21 are attached to construct the fan shroud 20 for accommodating the fan 10 inside the opening 20A of the fan shroud 20, the proximal end of the fan 10 does not touch the metal surface of the curved section 23 of the fan shroud 20, so that damage on the fan 10 can be prevented.

[Second Embodiment]

Figure 2:
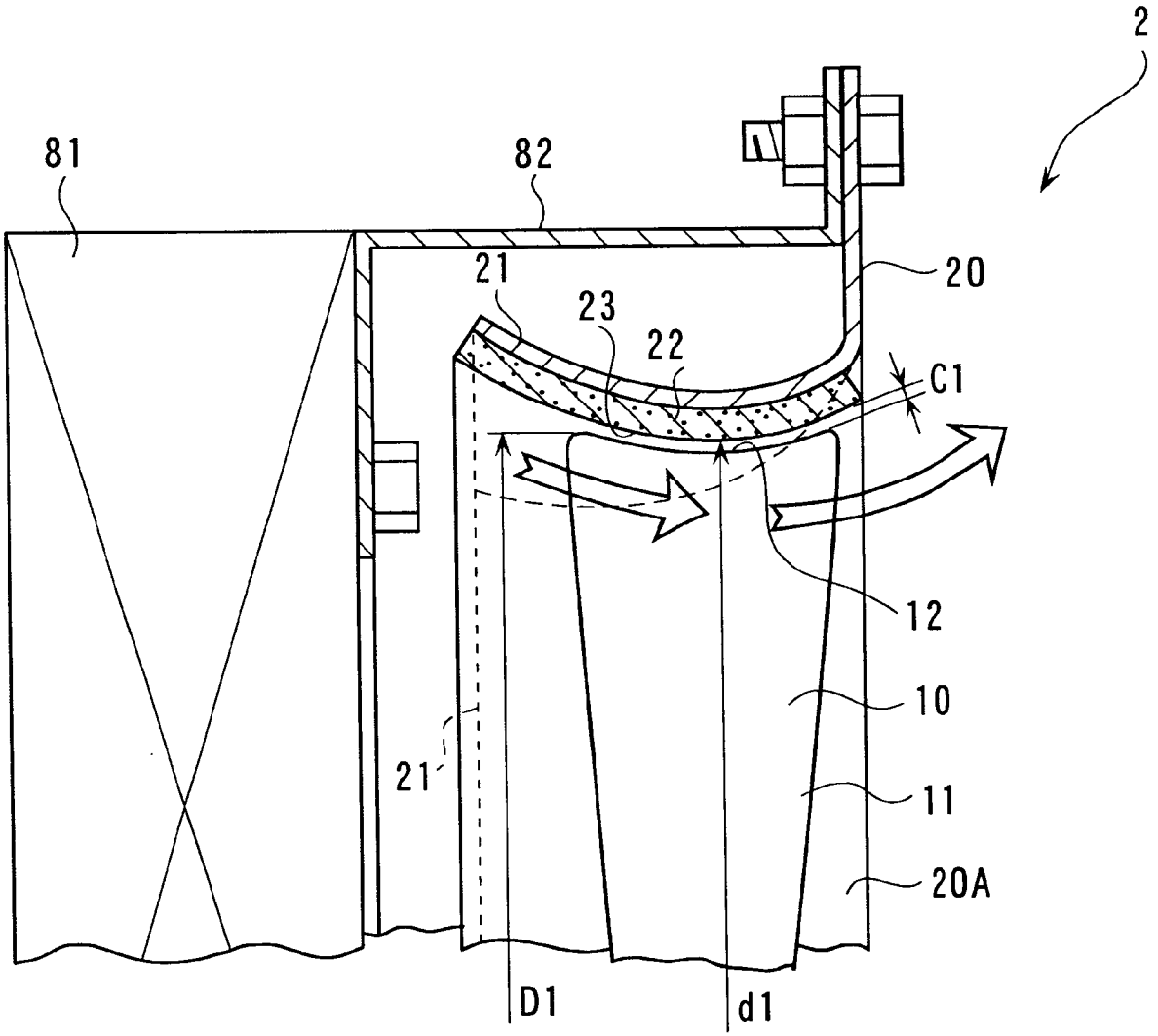
FIG. 2 is a cross section showing primary section of a fan device according to second embodiment of the present invention.

A fan device 2 according second embodiment shown in FIG. 2 has a noise absorbing material 22 attached to an entire inner circumference of the fan shroud 20, an inner circumference of the noise absorbing material 22 configured in a curved section 23 retaining the gap C1 against the fan 10.

The noise absorbing material 22 is formed by a porous material made of foamed urethane resin separately attached to respective shroud bodies 21. The noise absorbing material 22 is attached in advance to disposing the respective shroud bodies 21 to the outer circumference of the fan 10.

Incidentally, though the fan shroud 20 of the present embodiment and below-described respective embodiments is a divisible type composed of a plurality of shroud bodies, dividing position between the shroud bodies are not shown in the figure illustrating the respective embodiments.

According to the present embodiments, the aforesaid effects 1) and 2) can be obtained by the same arrangement as the first embodiment. Further, when the noise absorbing material 22 is attached to the respective shroud bodies 21 is advance and the fan 10 is accommodated in the fan shroud 20 in the same manner as the first embodiment, the proximal end of the fan 10 does not touch the noise absorbing material 20, so that the noise absorbing material 22 is not damaged. Accordingly, effect similar to the aforesaid effect 3) can be obtained for preventing damage of components. Further, following effect can be obtained in the present embodiment.

4) Since the inner circumference of the fan shroud 20 is formed of the noise absorbing material 22, jet noise by the swirl between the proximal end of the fan 10 and the fan shroud 20 can be effectively absorbed, thus remarkably reducing noise.

[Third Embodiment]

Figure 3:
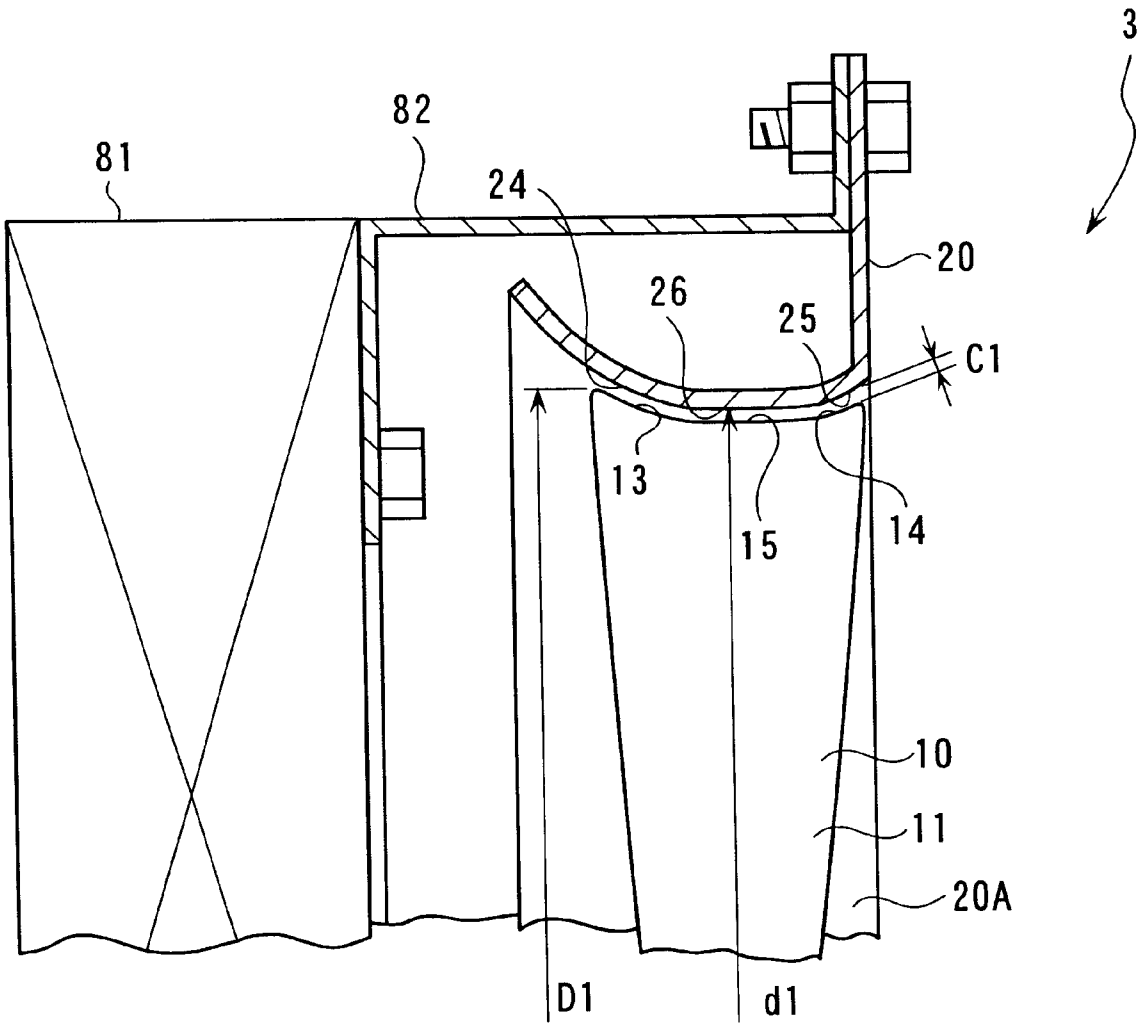
FIG. 3 is a cross section showing primary section of a fan device according to third embodiment of the present invention.

In a fan device 3 according to third embodiment shown in FIG. 3, the proximal end of the fan 10 has an upstream curved section 13 and a downstream curved section 14 respectively on both the right and left ends and a cylindrical section 15 parallel to the axis line of the rotation axis between the curved sections. However, the cylindrical section 15 may be slanted relative to the axis line. According to the fan 10, the rotation locus by the outer of the proximal end during rotation is center-dented on substantially the entire area in a direction parallel to the axis line, thus conforming to the flow of the cooling air.

The inner circumference of the fan shroud 20 is configured in a bell-mouth shape in accordance with the flow of the cooling air corresponding to the rotation locus of the fan 10 and has an upstream curved section 24, a downstream curved section 25 and cylindrical section 26 (a section having a linear cross section in axis line direction) between the curved sections. No noise absorbing material is provided to the inner circumference of the fan shroud 20 and a rigid surface such as metal surface of the fan shroud 20 is opposed to the rotation locus of the proximal outer configuration of the fan 10.

The gap C1 between the rotation locus by the proximal outer circumference of the fan 10 and the inner circumference of the fan shroud 20 is constant on the entire area.

The outer diameter D1 on the radiator 81 side of the fan 10 is greater than the minimum inner diameter d1 equal to the inner diameter of the cylindrical section 26 of the fan shroud 20.

In the present embodiment, since the outer diameter D1 on the radiator 81 side of the fan 10 is greater than the minimum inner diameter d1 of the fan shroud 20 in the fan device 1 as in the first embodiment, in order to accommodate the fan 10 in the fan shroud 20, the radiator 81 attached with the radiator hood 82 is disposed inside an engine room adjacent to the fan 10, and respective shroud bodies 21 (not shown) are sequentially attached to the radiator hood 82 while being disposed on the outer circumference side of the fan 10, thus constructing the frame-shaped fan shroud 20 to accommodate the fan 10 inside the opening 20A.

According to the present embodiment, since the proximal end of the fan 10 is formed of the upstream curved section 13, the downstream curved section 14 and the flat section 15 to make the rotation locus center-dented in accordance with the flow of the cooling air, the flow of the cooling air can be made smooth, so that the flow rate can be increased and the noise can be reduced, thus obtaining the aforesaid effect 1).

Further, the aforesaid effects 2) and 3) can also be obtained by the same arrangement as in the first embodiment.

[Fourth Embodiment]

Figure 4:
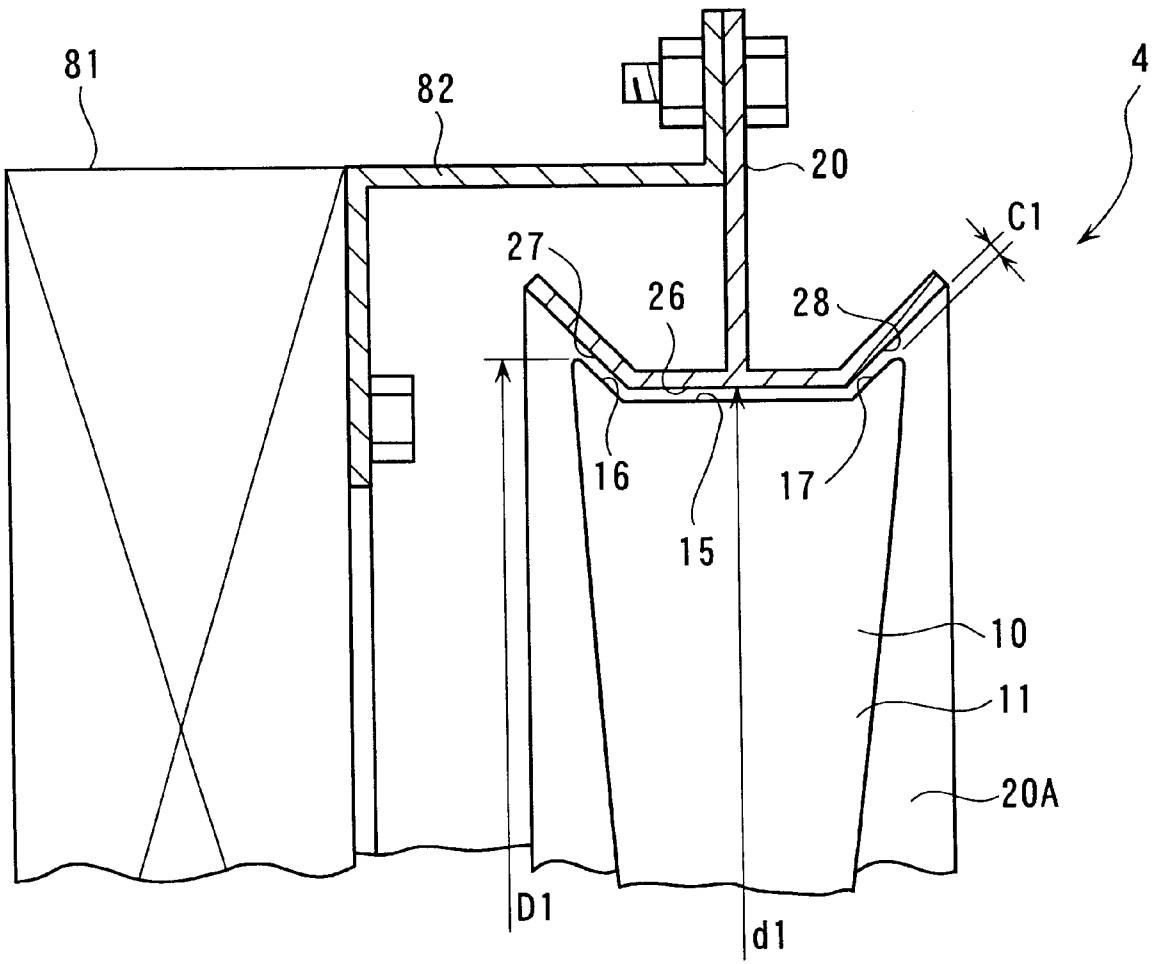
FIG. 4 is a cross section showing primary section of a fan device according to fourth embodiment of the present invention.

In a fan device 4 according to fourth embodiment shown in FIG. 4, a proximal configuration of the fan 10 is formed by an upstream conical section 16, a downstream conical section 17 respectively slanted relative to the axis line and a cylindrical section 15 between the conical sections. The respective upstream and downstream conical sections 16 and 17 are slanted to position away from diametral center toward the end (right and left ends in the figure) of the fan 10, so that the rotation locus of the fan 10 becomes center-dented to conform to the flow of the cooling air.

The inner circumference of the fan shroud 20 is formed by an upstream conical section 27 a downstream conical section 28 and a cylindrical section 26 between the flat sections, the inner circumference of the fan shroud being a conic opening to the upstream and downstream. In the present arrangement, no noise absorbing material is provided to the fan shroud 20.

The gap C1 between the rotation locus of the proximal outer circumference of the fan 10 and the inner circumference of the fan shroud 20 is constant on the entire area.

Further, the outer diameter D1 on the radiator 81 side of the fan 10 is greater than the minimum inner diameter d1 of the fan shroud 20.

Incidentally, though approximately upstream half of the fan 10 and the fan shroud 20 are accommodated in the radiator hood 82, the approximately downstream half is located to the outside.

In the present embodiment, since the rotation locus of the proximal outer circumference of the fan 10 and the fan shroud 20 conform to the flow of the cooling air, the effect 1) and effects similar to 2) and 3) can be obtained, thus achieving an object of the present invention.

[Fifth Embodiment]

Figure 5:
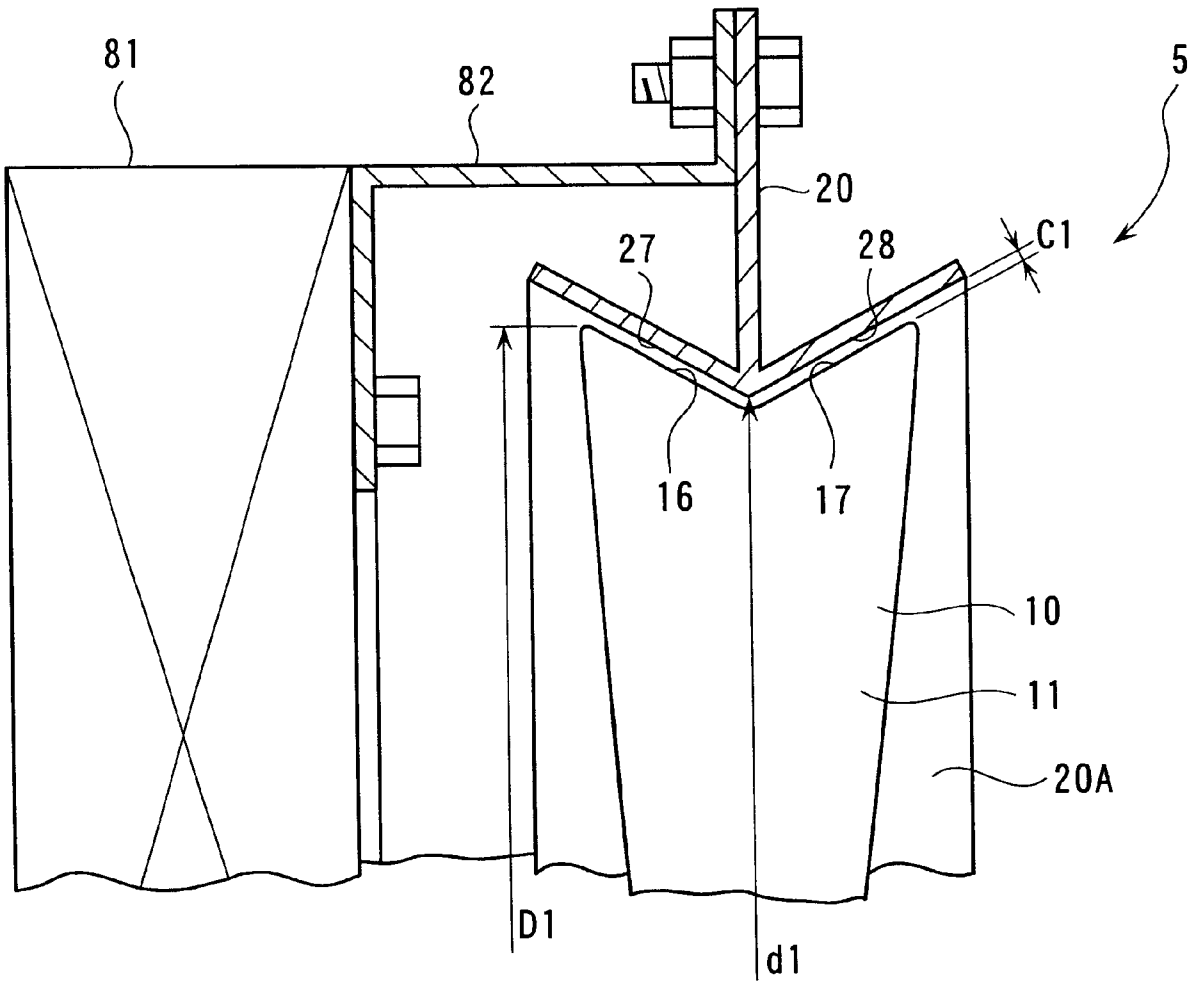
FIG. 5 is a cross section showing primary section of a fan device according to fifth embodiment of the present invention.

In a fan device 5 according to fifth embodiment shown in FIG. 5, the proximal outer circumference of the fan 10 is formed only by the upstream conical section 16 and the downstream conical section 17 slanted in a V-shape relative to the axis line of the rotation axis as illustrated. In the present configuration, the rotation locus of the proximal end of the fan 10 conforms to the flow of the cooling air.

The fan shroud 20 is formed only by the upstream conical section 27 and the downstream conical section 28 and is conic enlarging toward the upstream and the downstream respectively.

The other arrangement is the same as the aforesaid fourth embodiment.

In the present embodiment, the effects 1) to 3) can also be obtained.

[Sixth Embodiment]

Figure 6:
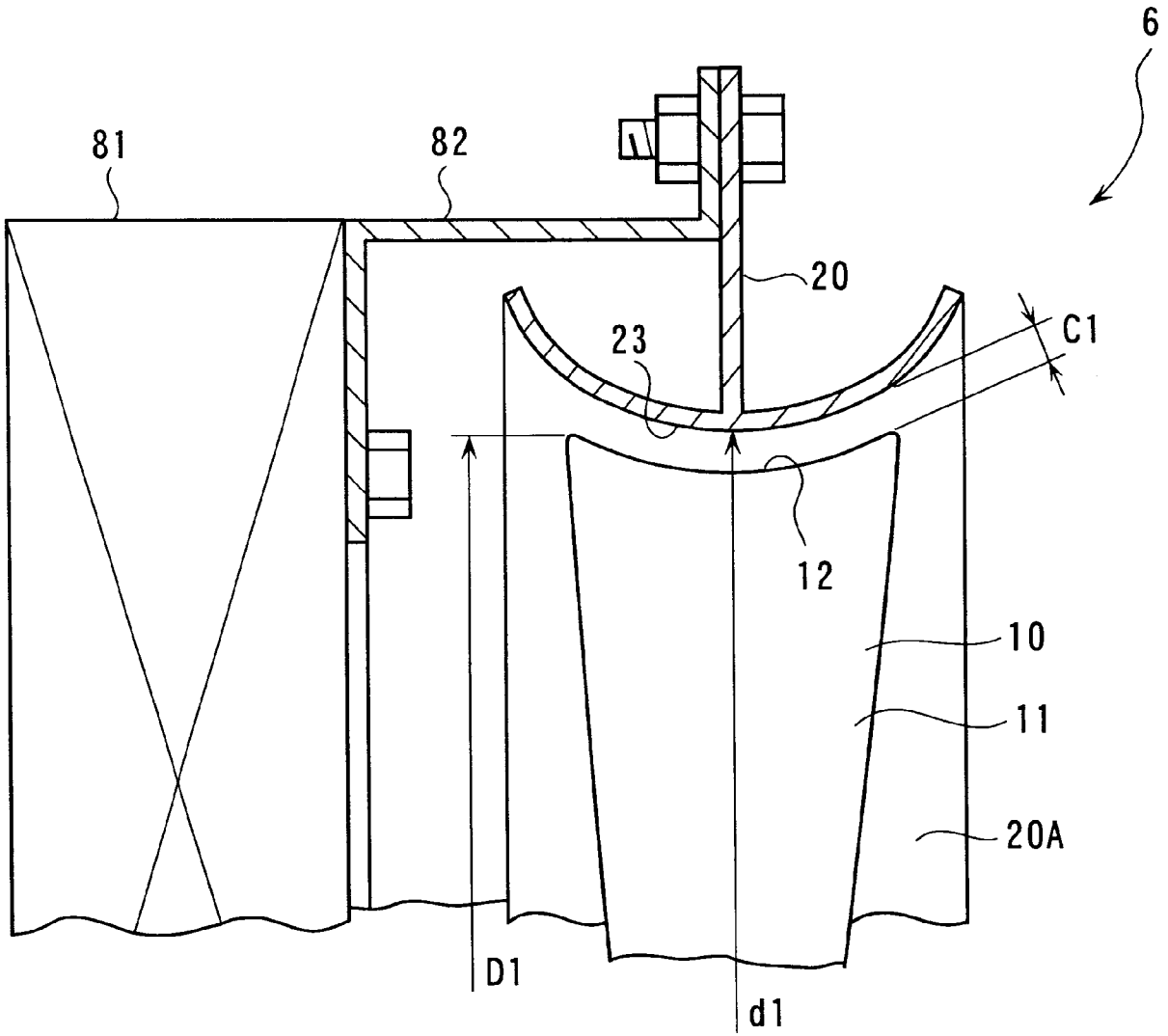
FIG. 6 is a cross section showing primary section of a fan device according to sixth embodiment of the present invention.

In a fan device 6 according to sixth embodiment shown in FIG. 6, though the shape of the fan 10 is substantially the same as the first embodiment and the inner circumference of the fan shroud 20 is arcuate, the fan device 6 is largely different from the other embodiments in that the outer diameter D1 of the fan 10 on the radiator 81 side is smaller than the minimum inner diameter d1 of the fan shroud 20.

Accordingly, in the fan device 6, the fan 10 can be accommodated in the fan shroud 20 after assembling the fan shroud 20 in the frame-shape, and the proximal end of the fan 12 does not touch the inner circumference of the fan shroud 20 made of a rigid surface material such as metal.

According to the present embodiment,following effect as well as the aforesaid effect 1) can be obtained.

5) Since the outer diameter D1 of the fan 10 on the radiator 81 side is smaller than the minimum inner diameter d1 of the fan shroud 20, the fan 10 can be accommodated in the fan shroud 20 without touching the inner circumference of the fan shroud 20 even after the fan shroud 20 is assembled in the frame-shape, thus preventing damage on the fan 10.

Further, since the fan 10 can be securely accommodated in the fan shroud 20 by disposing the radiator 81 attached with the fan shroud 20 into the engine room, the respective shroud bodies 21 are not necessarily attached to the radiator 81 side by putting hand in a narrow attachment space, thus facilitating attachment work of the fan shroud 20. Further, though the gap C1 between the rotation locus of the outer proximal end of the fan 10 and the fan shroud 20 is greater than the other embodiments, since respective configurations conform to the flow of the cooling air and the gap C1 stays constant on the entire area, the effect 2) can be obtained, though not so evident as the other embodiments.

[Seventh Embodiment]

Figure 7:
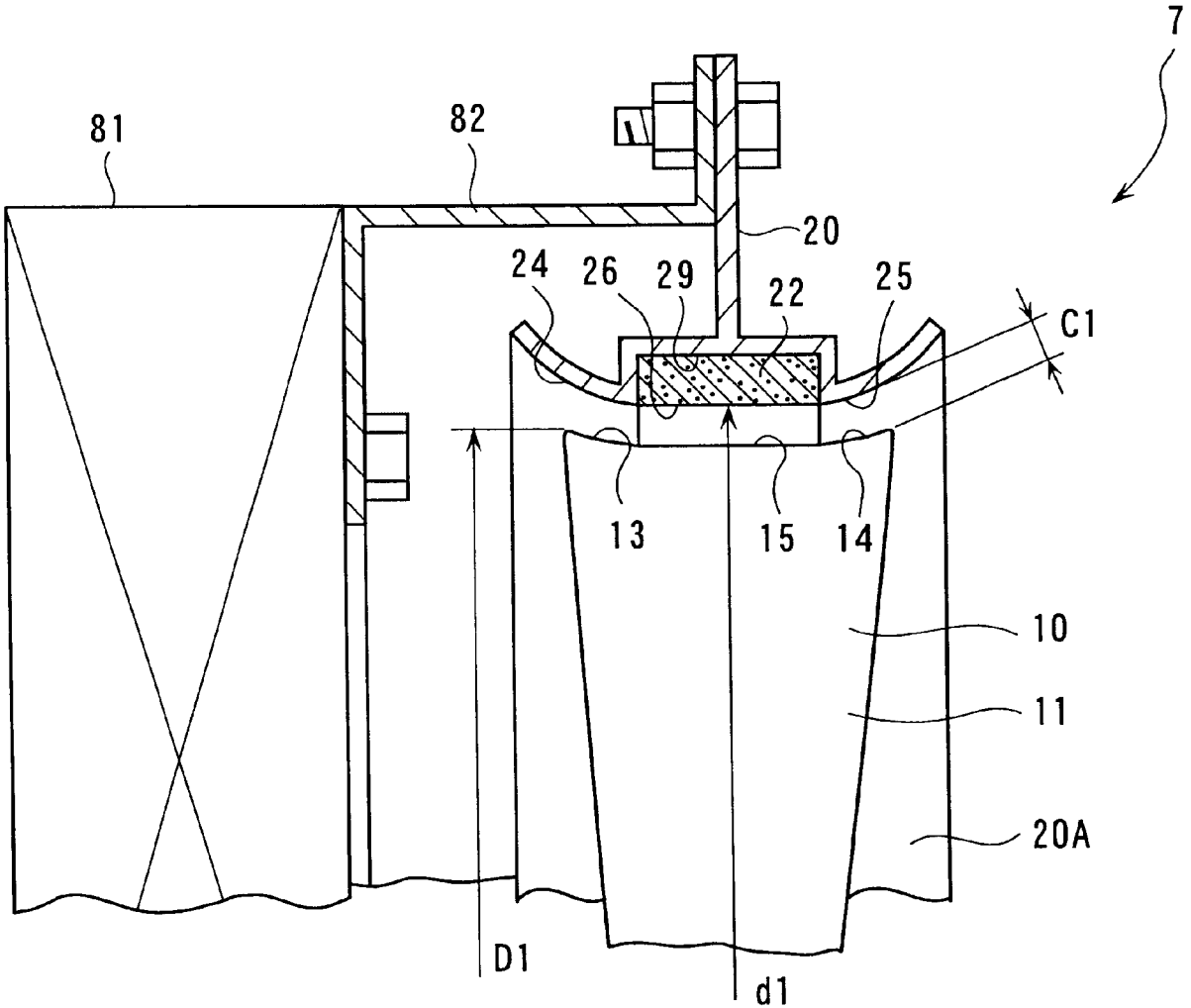
FIG. 7 is a cross section showing primary section of a fan device according to seventh embodiment of the present invention.

In a fan device 7 according to seventh embodiment shown in FIG. 7, the shape of the fan 10 is the same as the third embodiment and the outer diameter D1 of the fan 10 on the radiator 81 side is smaller than the minimum inner diameter d1 of the fan shroud 20. However, the configuration of the fan shroud 20 is different from the other embodiment.

Specifically, only the cylindrical section 26 of the inner circumference of the fan shroud 20 opposing the rotation locus formed by the cylindrical section 15 of the fan 10 is formed by a noise absorbing material 22 in the fan shroud 20 of the present embodiment. The noise absorbing material 22 is retained in a concave groove 29 continuously formed along circumference of the fan shroud 20.

According to the present embodiment, the aforesaid effect 3) can be obtained by the provision of the noise absorbing material 22 in addition to the aforesaid effects 1), 2) and 5) as in the sixth embodiment. Further, following effect can also be obtained.

6) Since the end of the noise absorbing material 22 (ends in right and left directions in the figure) is not exposed to the radiator 81 and the engine, damage of the noise absorbing material 22 on account of a foreign body such as small stone caught on the upstream and downstream sides of the fan 10 can be prevented, thus maintaining stable noise level.

[Modifications]

Incidentally, the scope of the present invention is not restricted to the aforesaid embodiment, but includes other arrangement as long as an object of the present invention can be attained, which includes following modifications etc.

For instance, though the noise absorbing material 22 is provided in the second embodiment in addition to the arrangement of the first embodiment, the noise absorbing material 22 may be provided to the fan shroud 20 of the fan devices 3 to 6 having no noise absorbing material 22, thus further reducing the noise.

On the contrary, the noise absorbing material 22 can be omitted by using the fan shroud 20 having a configuration as in the third embodiment, in the same manner as omitting the noise absorbing material 22 in the second embodiment as in the first embodiment.

In short, the noise absorbing material 22 may be used at will considering required noise level.

When the noise absorbing material 22 is used, any porous material having sound absorption ability can be used as the noise absorbing material 22 and is not restricted to the urethane resin.

In the second embodiment, the respective shroud bodies 21 having the noise absorbing material 22 are disposed around the fan 10 to accommodate the fan 10 inside the fan shroud 20, since the outer diameter D1 of the fan 10 is larger than the minimum inner diameter d1 of the fan shroud 20. However, since the inner diameter part smaller than the outer diameter D1 of the fan 10 is arranged as a part of the flexible soft noise absorbing material 22 in the fan shroud 20 attached with the noise absorbing material 22, the noise absorbing material 22 may not suffer any damage even when the proximal end of the fan 10 touches the noise absorbing material 22 because the proximal end touches the noise absorbing material 22 by only a small amount. In this case, the frame-shaped fan shroud 20 attached with the noise absorbing material 22 may be constructed in advance and the fan 10 may be accommodated in the fan shroud 20 while bringing the fan 10 into contact with the noise absorbing material 22 to elastically deform the noise absorbing material 22.

In the above process, since the noise absorbing material 22 can be attached after assembling the fan shroud 20 in the frame-shape, the noise absorbing material 22 is not required to be arranged in a small size corresponding to the size of the shroud body 21 and can be arranged in a band continuously covering the inner circumference of the fan shroud 20, thus efficiently conducting attachment work of the noise absorbing material 22.

Figure 8:
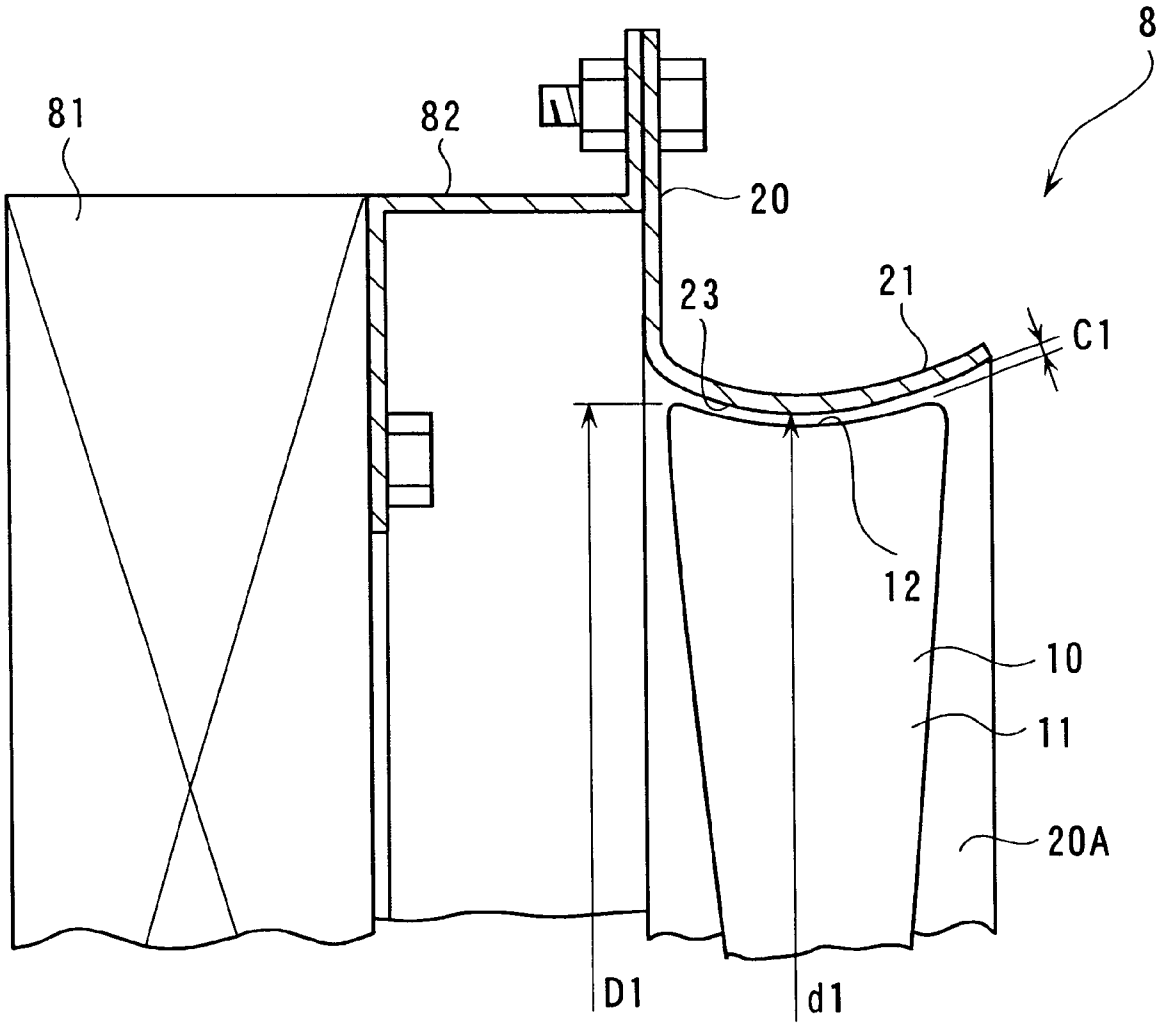
FIG. 8 is a cross section showing a modification of the present invention.

Though the fan shroud 20 is supported at the discharge side end or the intermediate section between the inlet side and the discharge side in the above respective embodiments, other arrangement is possible. For instance, the fan shroud 20 may be supported by the radiator hood 82 at the inlet side as shown in FIG. 8.

Figure 9:
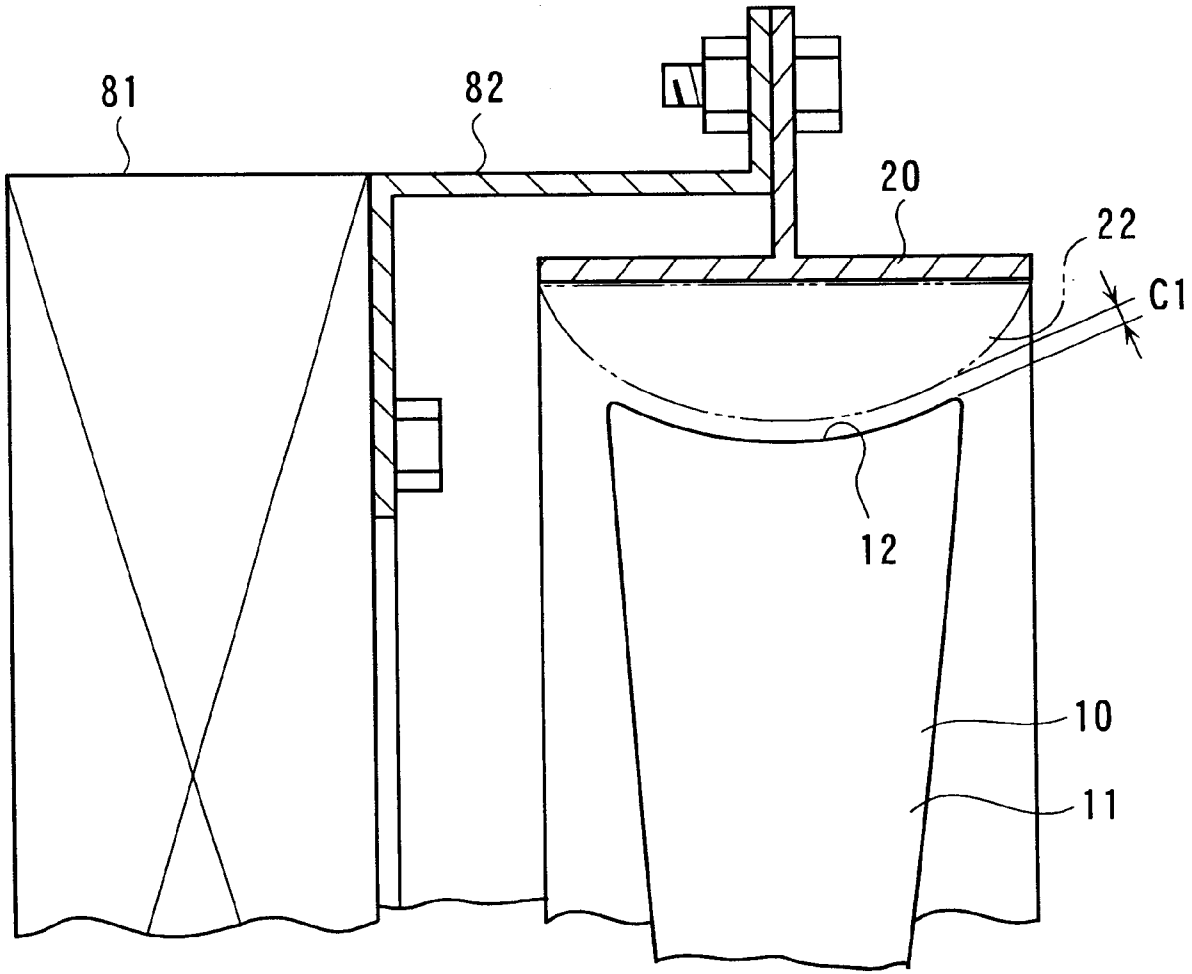
FIG. 9 is a cross section showing another modification of the present invention.

Further, though the inner circumference itself of the fan shroud 20 is formed in a bell-mouth shape in the above respective embodiments, the inner circumference may be formed in a simple cylinder, not the bell-mouth shape, as shown in FIG. 9. Further, as shown in double-dotted line in FIG. 9, the noise absorbing material 22 having center-convex cross section (a shape corresponding to the outer circumference configuration of the proximal end of the fan 10 such as camber) may be provided to the cylindrical inner circumference of the fan shroud 20 in the present invention.

The fan shroud according to the present invention may not necessarily be a divisible type as shown in the respective embodiments. Especially when the outer diameter D1 of the fan 10 on the radiator 81 side is smaller than the minimum inner diameter d1 of the fan shroud 20, the fan shroud 20 may be formed in a frame-shaped integral type, where the fan can be securely accommodated in the fan shroud 20 and the fan shroud 20 can be more easily attached on account of the integral arrangement.

Further, though the fan 10 is disposed to the downstream side of the radiator 81 and the radiator 81 is cooled by the cooling air on the inlet side of the fan 10, even when the fan 10 is disposed between the radiator 81 and the engine, the radiator 81 may be cooled by the cooling air discharged from the fan 10 by changing configuration and the rotation direction of the fan 10.

On the other hand, the fan 10 may be disposed on the upstream side of the radiator 81, so that the radiator 81 is cooled by the cooling air discharged from the fan 10. However, since the radiator 81 is located between the fan 10 and the engine and it is difficult to drive the fan 10 by the engine, the fan 10 may preferably be independently driven by a motor etc. When the radiator 81 is disposed between the fan 10 and the engine as in the above, the radiator 81 may be cooled by the cooling air on the inlet side of the fan 10.

The fan device according to the present invention can be used for engine cooling system of an industrial application including construction equipment such as an excavator and other vehicles or various industrial-cooling systems.

[Experiments]

Figure 10:
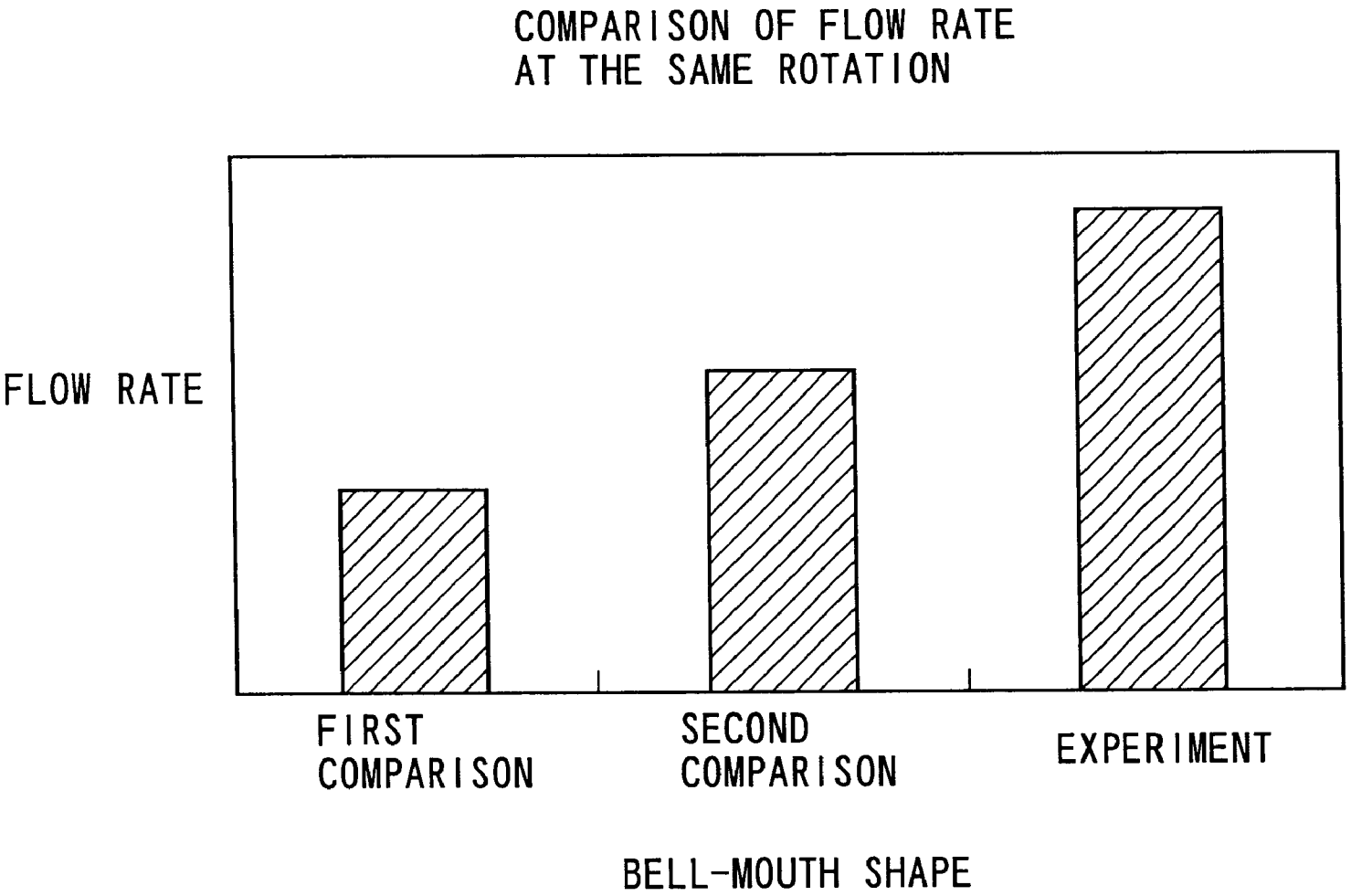
FIG. 10 is a graph showing difference in performance of experiments and comparisons.
Figure 11:
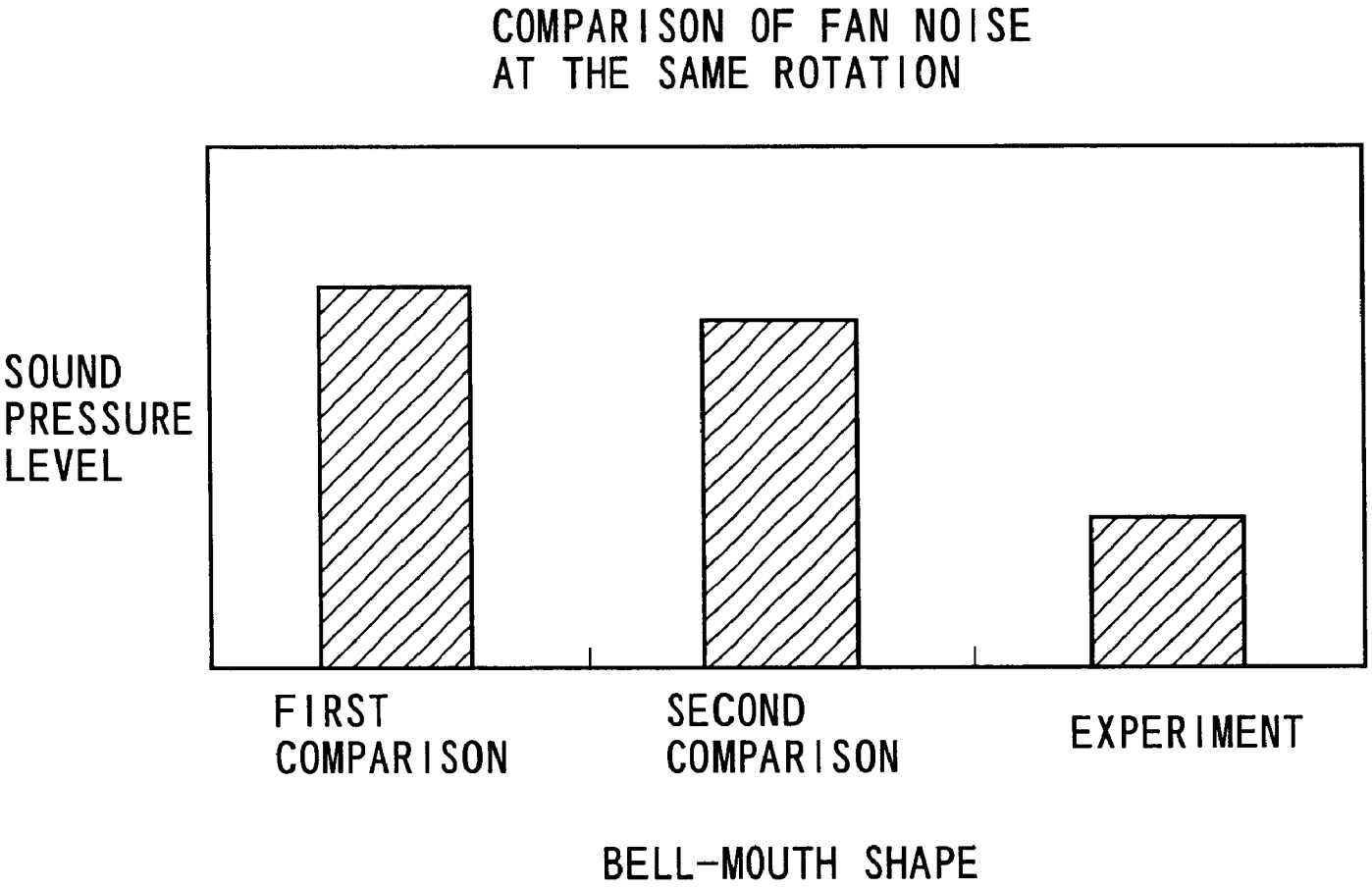
FIG. 11 is another graph showing further difference in performance of experiments and comparisons.
Figure 12:
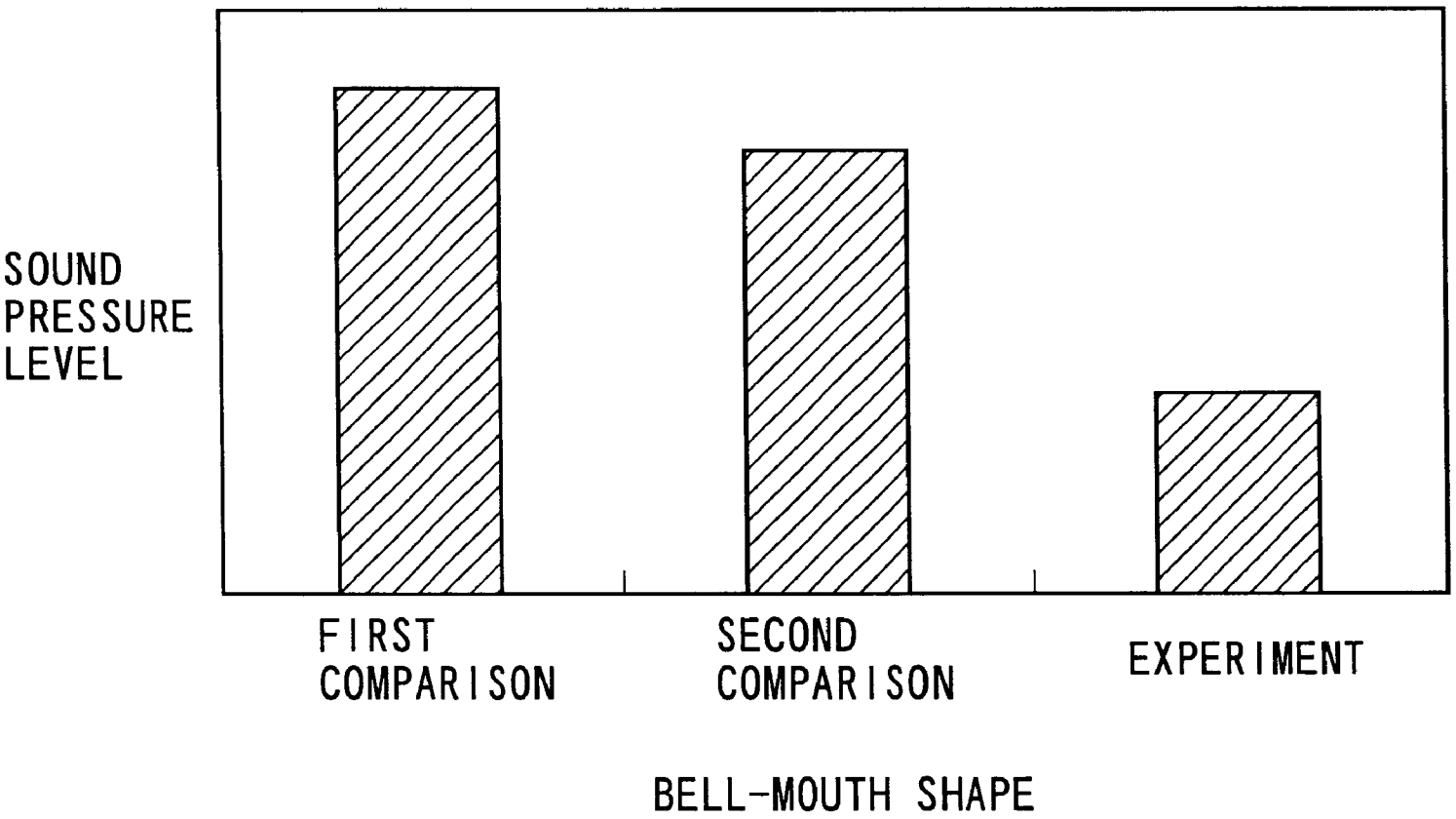
FIG. 12 is still another graph showing still difference in performance of experiments and comparisons.
Figure 13:
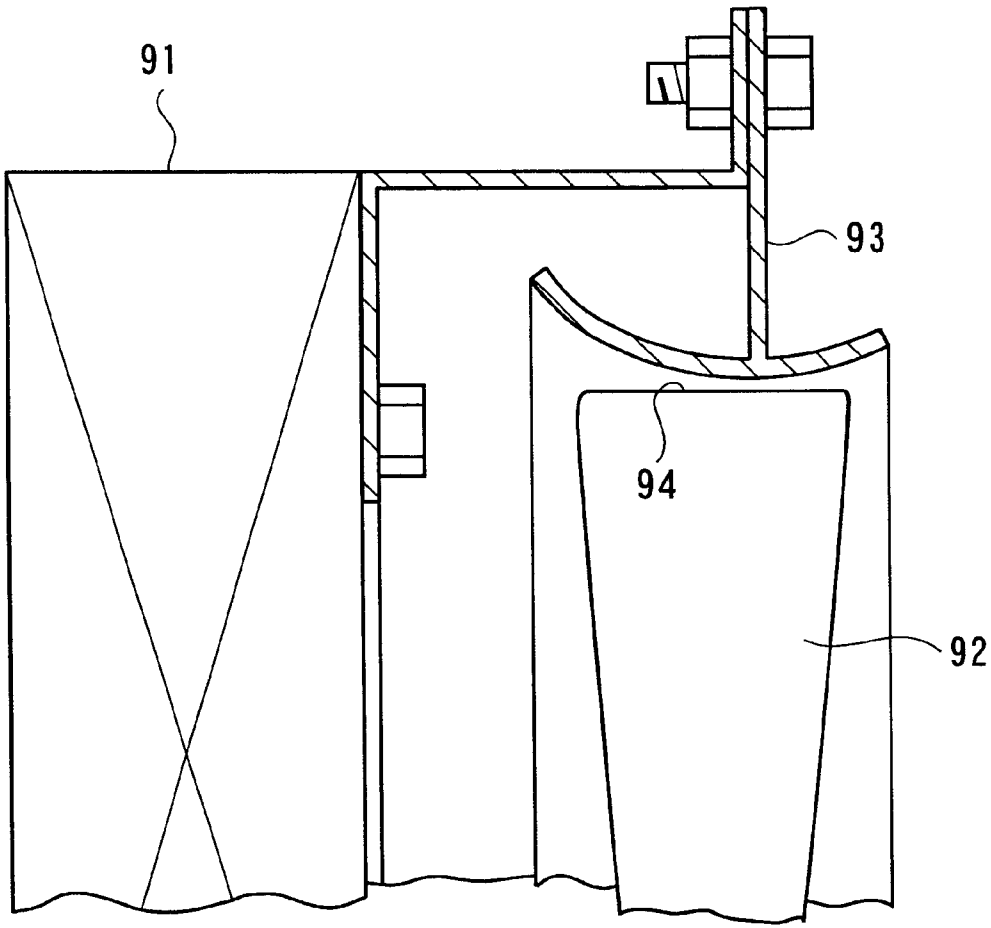
FIG. 13 PRIOR ART
FIG. 13 is a cross section showing a primary section of a conventional fan device.

A fan device according to an experiment of the present invention was prepared according to first embodiment shown in FIG. 1, and fan devices according to the first and second comparison were prepared according to the conventional example shown in FIG. 13. Performance of respective fan devices was compared regarding flow rate and noise during the same number of rotation and noise during the same flow rate. The results are shown in FIGS. 10 to 12.

Incidentally, the first comparison was a combination of a fan 92 composed of a straight section 94 parallel to axis line and a fan shroud 93 with upstream side and downstream side thereof being a bell-mouth shape as shown in FIG. 13. The second comparison was a combination of the same fan 92 as the first comparison and a fan shroud 93 having flat section extending along the fan 92 provided at the center of the upstream side and the downstream side of the bell-mouth shape.

According to results of comparison, when the respective devices were rotated at a constant rotation, only 97.5% of flow rate could be obtained in the first comparison as compared to the experiment. Though the flow rate was slightly improved in the second comparison on account of the difference in the configuration of the fan shroud 93 relative to the first comparison, only 98.5% of flow rate was obtained as compared to the experiment.

Accordingly, the flow rate at the same rotation could be securely increased in the experiment as compared to respective comparisons, and it was confirmed that the present invention was superior in flow rate increase to the conventional arrangement.

Incidentally, specific scale is not displayed in the graph shown in FIG. 10, which is the same in the FIGS. 11 and 12.

Further, as shown in FIG. 11, when the respective devices were rotated at a constant rotation, sound pressure level of the first comparison was higher than the experiment by approximately 2.5 dBA. Though the sound pressure level of the second comparison was slightly improved as compared to the first comparison, the sound pressure level was still higher than the experiment by approximately 2 dBA than the experiment.

On the other hand, as shown in FIG. 12, even when the respective devices were rotated to make the flow rate of the respective devices constant, the sound pressure level of the first comparison was higher than the experiment by approximately 3 dBA and the sound pressure level of the second comparison was higher than the experiment by approximately 2.5 dBA.

Accordingly, the noise at the same rotation and the same flow rate could be securely reduced in the experiment as compared to comparisons, thus confirming advantage of the present invention regarding noise.

What is claimed is:

1. A fan device, comprising: a rotary fan, a rotation locus of an outer configuration of a proximal end of the fan being center-dented where a middle section of the rotation locus is dented, in an entirely continuous concave configuration, relative to both sides thereof substantially entirely along a direction parallel to an axis line of a rotation axis of the fan.

2. The fan device according to claim 1, further comprising: a fan shroud spaced apart from the rotation locus of the proximal end of the fan by a predetermined gap, the gap being constant on substantially the entire area between the rotation locus and the fan shroud.

3. The fan device according to claim 2, wherein an outer diameter of the fan on a side of a body to be cooled is smaller than a minimum inner diameter of the fan shroud.

4. The fan device according to claim 2, wherein at least a part of an inner circumference of the fan shroud is formed of a porous noise absorbing material opposing to the rotation locus.

* * * * *